United States Patent [19]

Reinehr et al.

[11] Patent Number: 4,810,449

[45] **Date of Patent: * Mar. 7, 1989**

[54] PROCESS FOR THE PRODUCTION OF HYDROPHILIC POLYACRYLONITRILE FILAMENTS OR FIBERS

[75] Inventors: Ulrich Reinehr, Dormagen; Frank Druschke, Stuttgart; Peter Kleinschmidt, Dormagen, all of Fed. Rep. of Germany

[73] Assignee: Bayer Aktiengesellschaft, Leverkusen, Fed. Rep. of Germany

[ * ] Notice: The portion of the term of this patent subsequent to Oct. 26, 1999 has been disclaimed.

[21] Appl. No.: 88,174

[22] Filed: Aug. 21, 1987

Related U.S. Application Data

[63] Continuation of Ser. No. 614,182, May 25, 1984, abandoned, which is a continuation of Ser. No. 108,089, Dec. 28, 1979, abandoned, which is a continuation of Ser. No. 771,578, Feb. 24, 1977, abandoned.

[30] Foreign Application Priority Data

Feb. 27, 1976 [DE] Fed. Rep. of Germany ..... 2607996

[51] Int. Cl.[4] ..... D01F 6/18; D01D 5/06

[52] U.S. Cl. ..... 264/182; 264/211.16; 264/233

[58] Field of Search ..... 264/182, 206, 211.14, 264/211.15, 211.16, 233

[56] References Cited

U.S. PATENT DOCUMENTS

| | | | |
|---|---|---|---|
| 2,716,093 | 8/1955 | McClellan | 264/184 |
| 3,322,611 | 5/1967 | Stevenson | 264/182 |
| 4,143,200 | 3/1979 | Radlmann et al. | 428/373 |
| 4,180,617 | 12/1979 | Reinehr et al. | 428/398 |
| 4,356,134 | 10/1982 | Reinehr et al. | 264/182 |

FOREIGN PATENT DOCUMENTS

| | | | |
|---|---|---|---|
| 4605207 | 2/1971 | Japan | 264/182 |

*Primary Examiner*—Jan H. Silbaugh
*Assistant Examiner*—Hubert C. Lorin
*Attorney, Agent, or Firm*—Sprung Horn Kramer & Woods

[57] ABSTRACT

Hydrophilic polyacrylonitrile filaments or fibres where at least one filament-forming synthetic polymer is wet spun in a spinning solvent and wherein the spinning solvent has added to it from 10 to 20% by weight of a substance which is readily miscible with the spinning solvent and a washing liquid and is a nonsolvent for the polymer to be spun.

12 Claims, 1 Drawing Sheet

PROCESS FOR THE PRODUCTION OF HYDROPHILIC POLYACRYLONITRILE FILAMENTS OR FIBERS

This is a continuation of application Ser. No. 614,182, filed May 25, 1984, now abandoned, which is a continuation of application Ser. No. 108,089, filed Dec. 28, 1979, now abandoned, which is a continuation of application Ser. No. 771,578, filed Feb. 24, 1977, now abandoned.

This invention relates to a process for the production of hydrophilic fibres and filaments of synthetic polymers by a wet-spinning process.

For numerous applications, for example for bed linen or underwear, it is desirable to use textiles of manmade fibres which resemble natural fibres, such as cotton, in their behaviour with respect to moisture. Accordingly, there has been no shortage of attempts to improve the properties of manmade fibres which are unsatisfactory in this respect.

For example, highly hydrophilic natural fibres have been blended with synthetic fibres. It is also known that polyacrylonitrile for example can be mixed with a second acrylonitrile polymer containing from 30 to 80% by weight of a polyethylene oxide methacrylate, and the resulting mixtures spun (German Patent Specification No. 1,645,532). Acrylic fibres of this type which contain ethoxylated acrylic acid derivatives with chemically bound polyethylene oxide have long been known for their antistatic effect although their moisture absorption is not particularly high. Attempts have also been made to improve the hydrophilic properties by copolymerising certain monomers. According to Japanese Patent Application No. 2782/70, monomers with a hydrophilic group, for example acrylic acid derivatives, are copolymerised and subsequently hydrolysed.

In German Offenlegungsschrift No. 2,061,213, a specially substituted aerylamide is proposed as comonomer.

Attempts have also been made to improve hydrophilic properties by crosslinking. German Auslegeschrift No. 2,303,893 describes the hydrolysis with sulphuric acid of wet spun swollen acrylic fibres which contain the N-methylol compound of an unsaturated amide in copolymerised form. According to U.S. Pat. No. 3,733,386, fibres with improved moisture absorption are also obtained by crosslinking, i.e. by treating the fibres with aldehyde compounds and acids.

German Patent Specification No. 2,124,473 describes vacuole-containing fibres which are said to have cotton-like hydrophilic properties after treatment with a hydrophilic agent. In the absence of treatment with the hydrophilic agent, however, the hydrophilic properties of the fibres are unsatisfactory despite the vacuoles present and the fibres can only be used to a limited extent for certain purposes because they become fuzzy and "moult". In the course of their production, these fibres are treated with sodium hydroxide, for example, and this process involves various disadvantages.

However, despite the number and variety of methods which have been adopted, it has not yet been possible readily to produce synthetic fibres having hydrophilic properties which even remotely approach the favourable properties of cotton. Cotton has a moisture absorption of approximately 7% at 21° C./65% relative humidity and a water retention capacity of approximately 45%.

It has now surprisingly been found that an improvement in relation to conventional synthetic fibres in regard to their moisture absorption and water retention capacity is obtained by adding a liquid or a solid substance which has certain specific properties to the solvent for the polymer in a wet spinning process, and washing this substance out again after spinning.

Accordingly, it is an object of the present invention to provide a simple process for the production of fibres and filaments which are improved in relation to conventional synthetic fibres in regard to their moisture absorption and water retention capacity.

Other objects will be evident from the following description and the examples.

These objects are accomplished by a process for the production of hydrophilic filaments or fibres wherein at least one filament-forming synthetic polymer is wet spun in a spinning solvent and wherein the spinning solvent has added to it from 5 to 50% by weight, based on the solvent and solids, of a substance which:

(a) is readily miscible with the spinning solvent and with water; and (b) is a nonsolvent for the polymer to be spun.

It is possible by this process to obtain filaments and fibres with a core-jacket structure which have a moisture absorption of at least 2% (at 21° C./65% relative humidity) and a water retention capacity of at least 10%.

The polymers used for producing the filaments and fibres are preferably acrylonitrile polymers, of which acrylonitrile polymers consisting of at least 50% by weight of acrylonitrile units are preferred.

In cases where acrylonitrile copolymers are used, the hydrophilic properties of the fibres may be further improved by selecting comonomers with hydrophilic amino, sulpho, hydroxyl-N-methylol or carboxyl groups. Particularly suitable compounds are, for example, acrylic acid, methacrylic acid, methallyl sulphonic acid, acrylamides and the N-methylol compounds of an unsaturated acid amide, for example, N-methylol acrylamide and N-methylol methacrylamide. Mixtures of polymers may also be used.

Suitable spinning solvents are the solvents normally used for wet spinning, for example dimethyl acetamide, nitric acid, dimethyl sulphoxide, zinc chloride or sodium thiocyanate, but preferably dimethyl formamide.

The substance to be added to the spinning solvent has to satisfy the following requirements: it must be miscible, preferably in any ratio, both with the solvent and also with water or with any other liquid suitable for use as a washing liquid, such as ethanol or acetone for example, and it must be a non-solvent in the practical sense for the polymer used, in other words the polymer dissolves to only a limited extent in this substance.

Substances such as these are, for example, the monosubstituted and polysubstituted alkyl ethers and esters of polyhydric alcohols, glycerol and its homologs such as, for example, diethylene glycol mono- or -dimethyl, -ethyl and -butyl ether, diethylene glycol, triethylene glycol, tripropylene glycol, triethylene glycol diacetate, tetraethylene glycol, tetraethylene glycol dimethyl ether, glycol ether acetates such as, for example, butyl glycol acetates. Alcohols, for example, 2-ethyl cyclohexanol, organic carboxylic acids and inorganic and organic salts, for example, magnesium chloride, zinc sulphate, esters or ketones or even mixtures, for example of ethylene glycol acetates are also suitable.

It is preferred to use glycerol and its homologous derivatives. In addition to an individual substance, it is of course also possible to use mixtures of substances. The only important factor is that the substances used, in addition to their compatibility with the spinning solvent, should be readily soluble in water or any other liquid so that they may be removed during the aftertreatment of the fibres.

In addition, it is advantageous to use substances which do not form any azeotropic mixtures with the spinning solvent used so that, as in the case of DMF-glycerol or DMF-diethylene glycol mixtures, it may be almost completely recovered by fractional distillation.

These substances are added to the spinning solvent in quantities of from 5 to 50% by weight and preferably in quantities of from 10 to 20% by weight, based on the solvent and polymer solids. The upper limit to the quantity of substance added is determined in practice by the spinnability of the polymer solution. The higher the ratio by weight of added substance to the spinning solvent, the greater the degree of porosity in the fibre core and the better the hydrophilic properties of filaments produced from spinning solution mixtures such as these.

In the case of glycerol, quantities of up to about 15% by weight may be added to a 19% solution of polyacrylonitrile in dimethyl formamide. In order to obtain thorough admixture of the spinning solution, the spinning solvent, for example dimethyl formamide, containing the added substance is best added first of all, followed by addition of the polymeric powder to the thoroughly stirred solution because precipitation has been observed in cases where glycerol, for example, is directly added to polyacrylonitrile solutions in dimethyl formamide.

The hydrophilicity of the fibres thus produced may be influenced by the composition of the precipitation bath and by the particular aftertreatment applied. Depending upon the composition of the precipitation bath, it is possible to obtain core-jacket fibres with a porous core and a comparatively compact jacket or even porous fibres of even greater hydrophilicity with a less pronounced jacket surface.

If for example ACN-polymers are precipitated from DMF-glycerol mixtures with a polyacrylonitrile solids concentration of 19% by weight and a glycerol content of 14% by weight into a precipitation bath of 60% of dimethyl formamide and 40% of water at 30° C., followed by drawing and aftertreatment, fibres with pronounced core-jacket structures with a porous core and generally round cross-sectional forms are obtained. Their water retention capacity amounts to 80%.

If, by contrast, the ACN-polymers are precipitated from the corresponding glycerol mixture into a precipitation bath of glycerol at 60° C., followed by similar aftertreatment porous fibres without a pronounced jacket surface are obtained. The fibres generally have oval cross-sectional forms without any real deep indentations. Fibres as highly porous as these have a water retention capacity of approximately 120%.

Furthermore, if acrylic fibres, for example, are spun from a dimethyl formamide/glycerol mixture by the spinning process according to the invention, drawn in steam or water and then washed, dried and aftertreated, the original compact jacket surface of the fibres or filaments also becomes highly microporous as a result of glycerol diffusing out, so that acrylic fibres with particularly high hydrophilicity are obtained.

In the spinning of ACN-polymers from DMF-glycerol mixtures with a polyacrylonitrile solids concentration of 22% by weight and a glycerol content of 10.0% by weight, it was possible for the first time, by correspondingly aftertreating the spun filaments by the process described above, to obtain acrylic fibres with a water retention capacity of more than 120% and with a moisture absorption of more than 2%, which is equivalent to the hydrophilicity of cotton.

However, if the core-jacket fibres are first washed and then drawn, the compact jacket structure remains intact because the glycerol is washed out before drawing and the vacuoles formed as a result of glycerol diffusing out are closed again by the drawing process. Acrylic fibres with a compact jacket surface and, hence, lower hydrophilicity are obtained in this way (cf. Example 2).

The washing process may be carried out at temperatures of up to 100° C. The residence time should amount to at least 10 seconds in order thoroughly to wash out the added substance.

It has also been found to be advantageous in the washing process to keep the slivers or filaments under only weak tension or under minimal permitted shrinkage in order to maximise the removal of the additive.

The further aftertreatment of the slivers or filaments may be carried out by the methods normally used for this purpose: preparation, crimping, drying, cutting, the conditions under which the fibres are dried having a further influence upon their hydrophilicity.

Extremely mild drying conditions of at most 160° C., preferably from 110° to 140° C. and short residence times of at most 2 to 3 minutes in the dryer, give fibres with extremely high hydrophilicity.

An increase in the moisture absorption and water retention capacity of the porous fibres may also be obtained in cases where, immediately on leaving the precipitation bath, the fibres or filaments are drawn, brightened, dried and aftertreated in known manner to form fibres (cf. Example 3) rather than first washing and then drawing the fibres or filaments, as previously described.

As already mentioned, the filaments and fibres according to the invention have a core-jacket structure with a porous core or a substantially homogeneous microporous structure over their cross-section, depending upon the precipitation bath conditions. In the core-jacket structures, the core is microporous, the average pore diameter amounting to at most 1μ and, in general, it is between 0.5 and 1μ. The surface area of the core in a cross-section through the fibres generally amounts to between about 70% and 80% of the total cross-sectional area.

The jacket may be compact or also microporous, depending upon the aftertreatment conditions.

Whereas the cross-sectional forms of conventional wet-spun filaments and fibres is generally irregular, fragmented and indented, the filaments and fibres produced in accordance with the invention mainly have round to oval cross-sectional forms, generally without any really deep indentations. In addition to the hydrophilicity described above, they show good fibre properties, such as high tensile strength, elongation at break and good dyeability.

Another very considerable advantage in regard to wearing comfort is obtained when the fibres have a core-jacket structure. Whereas natural fibres, such as cotton for example, feel wet through in the event of high water absorption, that is not the case with the fibres having a core-jacket structure. It is assumed that this is attributable to the fact that the water absorbed diffuses into the microporous core. As a result, the fibres do not feel wet on the outside which is associated with a dry, comfortable feel.

Although thus far the description has largely been confined to acrylic fibres and their production, the invention is by no means limited to acrylic fibres. Linear aromatic polyamides such as, for example, the polyamide of m-phenylene diamine and isophthalyl chloride, or those which optionally contain heterocyclic ring systems, for example, polybenzimidazoles, oxazoles, thiazoles, etc., and which may be produced by a wet spinning process, are equally suitable for use in accordance with the invention.

Other suitable compounds are polymers with melting points above 300° C. which, in general, cannot be spun from the melt and are produced by a solution spinning process, for example by wet spinning.

The water retention capacity of fibres is an important physical parameter in cases where they are used for clothing. The effect of a high water retention capacity is that, in the event of heavy perspiration, textiles worn close to the skin are able to keep the skin relatively dry and hence to improve wearing comfort.

Determination of Water Retention Capacity (WR)

The water retention capacity is determined in accordance with DIN 53 814 (cf. Melliand Textilberichte 4 1973, page 350).

The fibre samples are immersed for 2 hours in water containing 0.1 wetting agent. Thereafter the fibres are centrifuged for 10 minutes with an acceleration of 10,000 m/sec$^2$ and the quantity of water retained in and between the fibres is gravimetrically determined. In order to determine their dry weight, the fibres are dried at 105° C. until they have a constant moisture content. The water retention capacity (WR) in % by weight is:

$$WR = \frac{m_f - m_{tr}}{m_{tr}} \times 100$$

$m_f$=weight of the moist fibres
$m_{tr}$=weight of the dry fibres.

Determination of Moisture Absorption Capacity (MA)

The moisture absorption of the fibres, based on their dry weight, is gravimetrically determined. To this end, the samples are exposed for 24 hours to a climate of 21° C./65% relative air humidity. To determine their dry weight, the samples are dried at 105° C. until constant in weight. The moisture absorption (MA) in % by weight is:

$$MA = \frac{m_f - m_{tr}}{m_{tr}} \times 100$$

$m_f$=moist weight of the fibres at 21° C./65% relative humidity,
$m_{tr}$=dry weight of the fibres.

The invention is further illustrated but by no means limited by the following Examples, in which the parts and percentages quoted are based on weight,unless otherwise stated.

EXAMPLE 1

20 kg of dimethyl formamide are mixed while stirring in a vessel with 2.95 kg of glycerol. 6.5 kg of an acrylonitrile copolymer of 93.6% of acrylonitrile, 5.7% of acrylic acid methyl ester and 0.7% of sodium methallyl sulphonate are then added while stirring, followed by further stirring for 1 hour at 80° C. and filtration. The spinning solution thus produced is wet spun from a 150-bore spinneret by methods known in the art.

The precipitation bath consists of 45% of dimethyl formamide and 55% of water. The precipitation bath temperature is 56° C. The take-off rate amounts to 5 m/minute.

The viscosity of the spinning solution, which has a solids concentration of 22% and a glycerol content of 10% by weight, based on the dimethyl formamide plus polyacrylonitrile powder, amounts to 135 poises. The spun material with a denier of 1470 dtex is collected on bobbins and doubled into a tow with an overall denier of 102, 900.

The tow is then drawn in a ratio of 1:4.5 in boiling water, washed for 3 minutes under low tension in boiling water and treated with an antistatic preparation. It is then dried at a maximum of 130° C. in a screen drum dryer with 20% permitted shrinkage, and cut into fibres with a staple length of 60 mm.

The individual fibres with a final denier of 2.7 dtex have a moisture absorption capacity of 2.5% and a water retention capacity of 38.0%.

Tensile strength: 2.0 p/dtex; elongation at break 31%.

Figure 1:
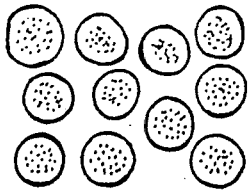
FIG. 1 is a photograph taken with an optical microscope of the cross-section of fibres according to Example 1 with a core-jacket structure (magnified 320 times).

As shown by the photograph taken with an optical microscope of their cross-sections in FIG. 1 (magnified 320 times), the fibres have a pronounced core-jacket structure with substantially circular cross-sectional forms.

Figure 2:
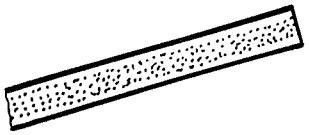
FIG. 2 is a photograph taken with an optical microscope of the longitudinal section of a fibre according to Example 1 (magnified 320 times).

FIG. 2 is a photograph taken with an optical microscope of the longitudinal section of a filament (magnified 320 times). In this case, too, the core-jacket structure with a fairly compact jacket and a fine-pored core is distinctly visible.

The residual solvent content of the fibres is less than 0.2% by weight whilst the residual glycerol content amounts to 0.6% by weight. The fibres can be deeply dyed throughout with a blue dye corresponding to the formula

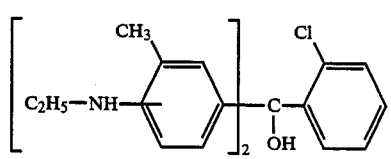

The extinction value is 1.28 for 100 mg of fibre per 100 ml of dimethyl formamide (570 mμ, 1 cm cuvette).

Yarns with a count of 36/1 were spun from the fibres with a final denier of 2.7 dtex and made up into pieces of knitting. The pieces of knitting, which were left natural white on the one hand and dyed blue on the other, were found to have a moisture absorption of 2.4% and a water retention capacity of 40.3%.

EXAMPLE 2

An acrylonitrile polymer with the same chemical composition as in Example 1 was dissolved in a mixture of dimethyl formamide and glycerol, filtered and wet-spun under the same conditions. The spun material was collected on bobbins and doubled into a tow with an overall denier of 102,900 dtex. The material was then washed in boiling water for 3 minutes under low tension, subsequently drawn in a ratio of 1:6.5, treated with antistatic preparation and aftertreated in the same way as described in Example 1.

The fibres with an individual denier of 3.3 dtex have a moisture absorption of 2.5%. Their water retention capacity amounts to 11%. The fibres again have a pronounced core-jacket structure and a circular cross-section.

In contrast to the fibres according to Example 1, the jacket surface is more compact and is free from vacuoles. This explains the relatively lower hydrophilicity of the fibres in comparison with Example 1. On account of the modified aftertreatment, the vacuoles formed by removal of the glycerol during washing are partly closed again by the drawing process carried out after washing.

EXAMPLE 3

(a) 15.0 kg of dimethyl formamide are mixed while stirring in a vessel with 3.14 kg of glycerol. 4.25 kg of an acrylonitrile copolymer with the same chemical composition as in Example 1 are then added while stirring, followed by stirring for 1 hour at 80° C. and filtration. The spinning solution thus obtained is wet spun from a 500-bore spinneret.

The precipitation bath consists of 50% of glycerol, 30% of dimethyl formamide and 20% of water. The precipitation bath temperature is 30° C. The take off rate amounts to 5 m/minute. The viscosity of the spinning solution, which has a solids concentration of 19% and a glycerol content of 14% by weight, based on dimethyl formamide+polyacrylonitrile powder, is 50 poises.

The spun material with a denier of 8550 dtex is collected on bobbins, doubled into a tow, drawn in a ratio of 1:5.0 in boiling water and aftertreated in the same way as described in Example 1. The individual fibres with a final denier of 4.2 dtex have a moisture absorption capacity of 2.6% and a water retention capacity of 70%. The fibres have a pronounced core-jacket structure and a circular cross-section without any indentations.

(b) Part of the spinning solution was spun into a precipitation bath of glycerol. The precipitation bath temperature was 60° C., and take off rate was again 5 m/minute. The spun material with a denier of 8850 dtex was collected on bobbins doubled into a tow and aftertreated in the same way as described in Example 1. The individual fibres with a final denier of 4.2 dtex have a moisture absorption capacity of 2.9% and a water retention capacity of 120%.

Figure 3:
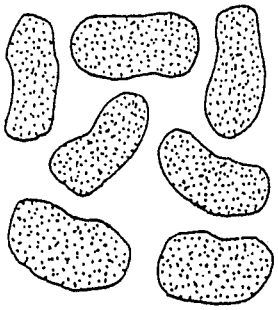
FIG. 3 is a photograph taken with an optical microscope of the cross-section of fibres according to Example 3b (magnified 320 times).

After the precipitation process, the fibres have a uniformly distributed, porous structure without a pronounced jacket surface, an oval cross-section and no really deep indentations, as shown by the photograph taken with an optical microscope of their cross-sections in FIG. 3 (magnified 320 times). The high water retention capacity is explained by the totally porous fibre structure.

EXAMPLE 4

13.4 kg of dimethyl formamide were mixed while stirring in a vessel with 2.05 kg of 1,2,4,5-benzene tetracarboxylic acid. 4.1 kg of an acrylonitrile copolymer with the same chemical composition as that of Example 1 were then added while stirring, followed by stirring for 1 hour at 80° C. and filtration. The spinning solution thus obtained was wet-spun from a 500-bore spinneret. The precipitation bath consisted of 45% of dimethyl formamide and 55% of water. The precipitation bath temperature was 56° C. and the take-off rate 5 m/minute. The viscosity of the spinning solution which has a solids concentration of 21% and a pyromellitic acid content of 10.5% by weight, based on the dimethyl formamide plus polymer powder, was 125 poises. The spun material was again collected on bobbins, doubled into a tow, drawn in a ratio of 1:4.0 in boiling water and aftertreated in the same way as described in Example 1. The individual fibres with a final denier of 6.5 dtex have a moisture absorption of 3.1% and a water rentention capacity of 130%. The fibres again have a core-jacket structure and round cross-sectional forms.

EXAMPLE 5 (Comparison)

(a) An acrylonitrile copolymer with the same chemical composition as in Example 1 was wet-spun from a 500-bore spinneret from a 22% by weight spinning solution in dimethyl formamide. The precipitation bath consists of 50% of glycerol, 30% of dimethyl formamide and 20% of water. The precipitation bath temperature is 30° C. and the take-off rate 5 m/minute. The spun material was again collected on bobbins, doubled, drawn in a ratio of 1:5.0 in boiling water and aftertreated in the same way as described in Example 1. The individual fibres with a final denier of 4.1 dtex shows the usual round to oval cross-sectional forms. There is no core-jacket structure. The moisture absorption amounts to 1.6% and the water retention capacity to 13.0%.

Figure 4:
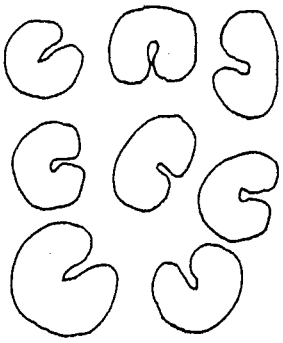
FIG. 4 is a photograph taken with an optical microscope of the cross-section of fibres according to Example 5b which do not correspond to the invention (magnified 320 times).

(b) Part of the spinning solution was spun into a precipitation bath of pure glycerol. The precipitation bath temperature is 60° C. and the take-off rate was 5 m/minute. The spun material was again aftertreated in the same way as described in Example 1. After the precipitation process, the fibres show horseshoe-shaped to kidney-shaped, deeply indented cross-sections with a compact structure, as shown by the photograph taken with an optical microscope of their cross-sections in FIG. 4 (magnified 320 times). The fibres have a moisture absorption of 1.7% and a water retention capacity of 18%.

What we claim is:

1. A process for the production of hydrophilic polyacrylonitrile filaments or fibers having a sheath-core structure, a microporous core, a moisture absorption of at least 2% at 21° C. and 65% relative humidity, and a water retention capacity of at least 10%, which comprises forming filaments or fibers by wet spinning a fiber-forming wet-spinnable synthetic polyacrylonitrile copolymer as a composition containing, in addition to a spinning solvent which is selected from the group consisting of dimethyl acetamide, dimethyl formamide and dimethyl sulphoxide, from 10 to 20% by weight based on the spinning solvent and polymer solids content, of non-solvent for the polymer to be spun, which non-solvent is miscible with the spinning solvent and with a liquid suitable for use as a washing liquid, precipitating said composition in a precipitating bath and washing said spinning solvent and said non-solvent from said hydrophilic polyacrylonitrile filaments or fibers.

2. A process according to claim 1, in which the core of said hydrophilic polyacrylonitrile filaments or fibers have pores with an average size of at most 1 micron.

3. A process according to claim 1, wherein said solvent is dimethyl formamide.

4. A process according to claim 3, wherein said non-solvent is glycerol.

5. A process according to claim 4, wherein said non-solvent consists essentially of glycerol.

6. A process according to claim 1, wherein said copolymer is a copolymer containing at least 50% by weight acrylonitrile units.

7. A process according to claim 6, wherein said copolymer is a copolymer containing units of acrylic acid methyl ester and sodium methallyl sulfonate.

8. A process according to claim 1, wherein the solvent is dimethyl acetamide.

9. A process according to claim 1, wherein the solvent is dimethyl sulfoxide.

10. A process according to claim 1, wherein the polymer solids content is up to 22 weight %.

11. A process according to claim 1, wherein the non-solvent is selected from the group consisting of mono-substituted alkyl ethers, polysubstituted alkyl ethers, esters of polyhydric alcohols, glycerol, homologs of glycerol, alcohols, organic carboxylic acids, esters of ethylene glycol acetates and mixtures of ethylene glycol acetates.

12. A process according to claim 11, wherein the homologs of glycerol are selected from the group consisting of diethylene glycol mono- or -dimethyl, -ethyl and -butyl ether, diethylene glycol, triethylene glycol, tripropylene glycol, triethylene glycol diacetate, tetraethylene glycol, tetraethylene glycol dimethyl ether and glycol ether acetates.

* * * * *